US005889732A

United States Patent [19]

Fukuyama et al.

[11] Patent Number: 5,889,732

[45] Date of Patent: Mar. 30, 1999

[54] SOUNDER

[75] Inventors: Takanori Fukuyama; Yoshinobu Sengiku; Mitsutaka Enomoto; Kazuhiro Yoshida, all of Mie; Kazuya Yamasaki, Osaka, all of Japan

[73] Assignee: Matsushita Electric Industrial Co., Ltd., Osaka, Japan

[21] Appl. No.: 836,003

[22] PCT Filed: Sep. 3, 1996

[86] PCT No.: PCT/JP96/02489

§ 371 Date: Jun. 25, 1997

§ 102(e) Date: Jun. 25, 1997

[87] PCT Pub. No.: WO97/09860

PCT Pub. Date: Mar. 13, 1997

[30] Foreign Application Priority Data

Sep. 4, 1995 [JP] Japan ..... 7-226188

[51] Int. Cl.[6] ..... H04R 13/00; G10K 9/13

[52] U.S. Cl. ..... 367/175; 381/396

[58] Field of Search ..... 367/168, 173, 367/174, 175; 381/192, 194, 199, 396, 412

[56] References Cited

U.S. PATENT DOCUMENTS

| | | | |
|---|---|---|---|
| 4,504,703 | 3/1985 | Schneiter et al. | 381/191 |
| 5,394,479 | 2/1995 | Ishigaya et al. | 381/192 |
| 5,432,758 | 7/1995 | Sone | 367/175 |
| 5,642,333 | 6/1997 | Imahori et al. | 367/175 |

FOREIGN PATENT DOCUMENTS

| | | |
|---|---|---|
| 61-169098 | 7/1986 | Japan . |
| 62-204700 | 9/1987 | Japan . |
| 6-339197 | 12/1994 | Japan . |

*Primary Examiner*—Ian J. Lobo
*Attorney, Agent, or Firm*—McDermott, Will & Emery

[57] ABSTRACT

A sounder has a first plate 1 that is molded into a lower case. The first plate functions not only as part of a magnetic circuit, but also as a terminal on the outside of the sounder. The first plate has a coil positioned around a center pole on the first plate and a coil connector for attachment to an end of the coil. A second plate 5 is molded into the lower case and also has a coil connector for attachment to another end of the coil. Accordingly, both ends of the coil can be coupled to the connectors on the inside of the sounder. With this arrangement, the outside of the plates are conductive to an outside connector terminal, thereby eliminating having to pull out both ends of the coil from behind the plates.

12 Claims, 4 Drawing Sheets

FIG. 1A
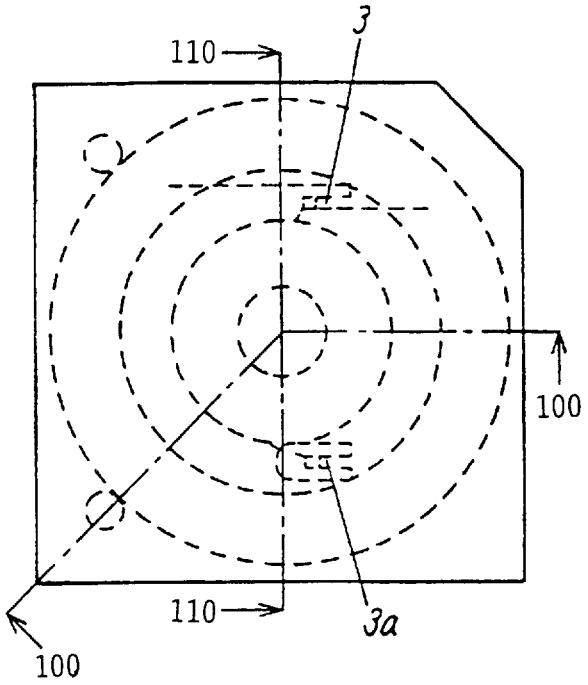
FIG. 1C
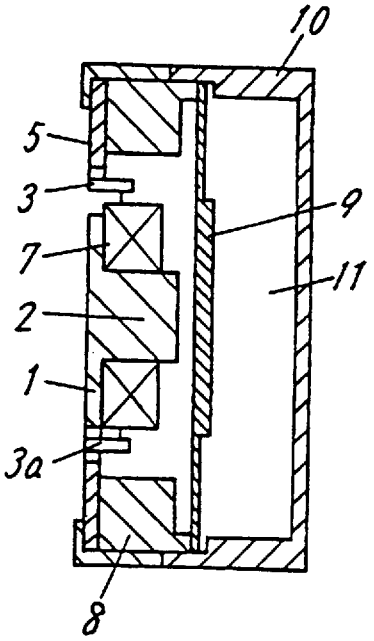
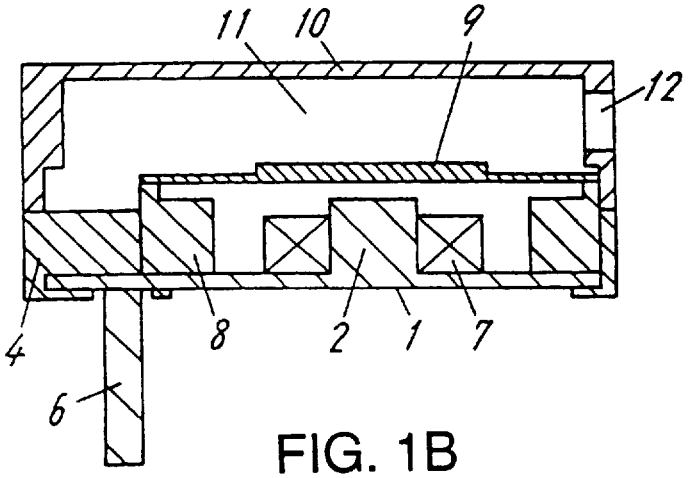
FIG. 1B

FIG. 2A
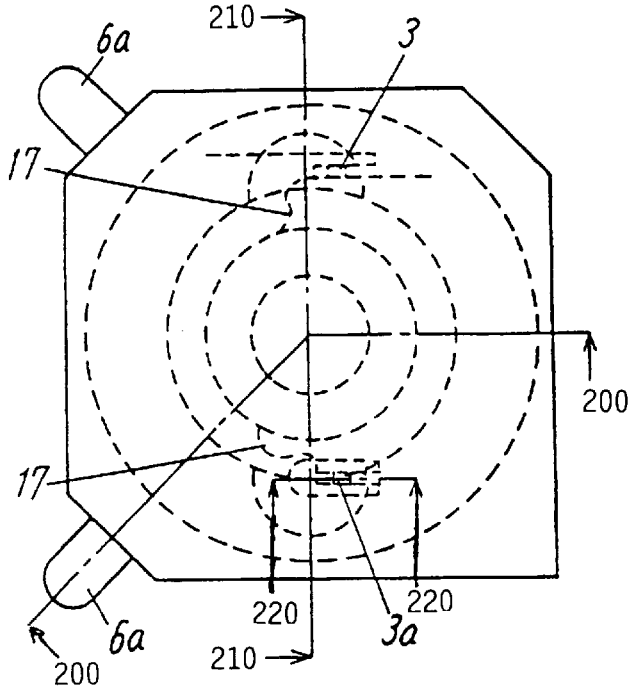
FIG. 2C
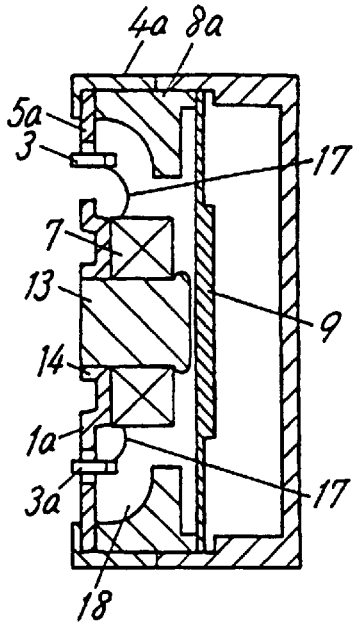
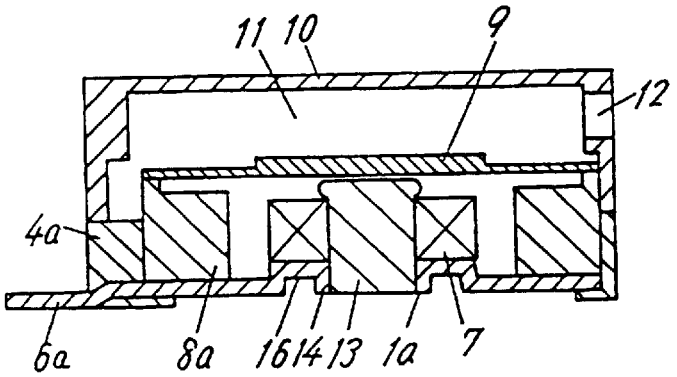
FIG. 2B
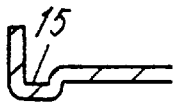
FIG. 2D

FIG. 3A
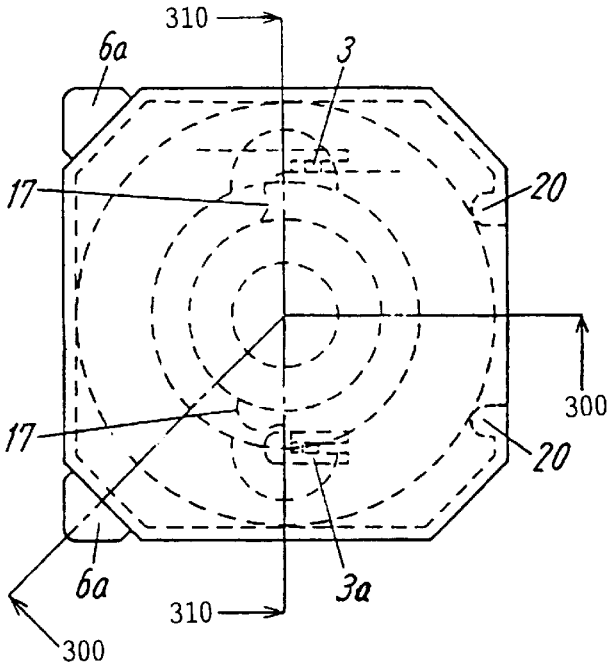
FIG. 3C
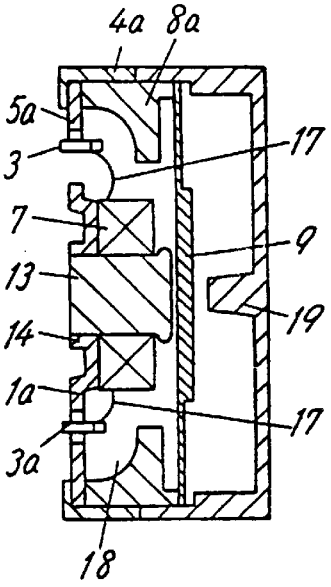
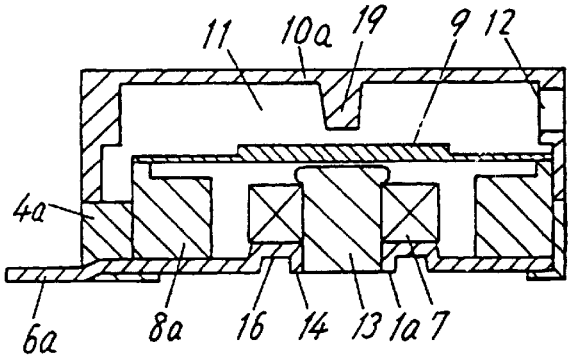
FIG. 3B
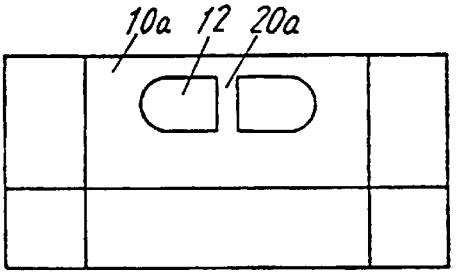
FIG. 3D

SOUNDER

BACKGROUND OF THE INVENTION

The present invention relates to a sounder, which is used for producing a "ringer sound" by reproducing a specific frequency band-width. The sounder is built in various mobile communication apparatuses.

A conventional sounder is depicted in FIG. 4A and FIG. 4B. FIG. 4A is a plan view of a conventional sounder, and FIG. 4B is a cross sectional view of the same sounder.

A ring-shape magnet 21 is formed by injection molding a resin magnet. A plate 22 is formed by an insert mold at the same time as when the ring-shape magnet 21 is produced by injection molding. The plate 22 has a center pole 23, a hole 24 for leading out the ends of a coil 26, and a hole 25 for providing the back side of the sounder with an opening.

The coil 26 is laid around the center pole 23 of the plate 22. Each end of the coil 26 is pulled out from the hole 24 of the plate 22, and connected to an electrode of a printed circuit board 27, which board is coupled to the back side of the plate 22. A diaphragm 28 is disposed on the magnet 21 to cover an outer periphery of the magnet 21 so that a uniform magnet gap 29 can be provided between the diaphragm 28 and an upper face of the center pole 23.

A resonant cover 30 is connected to the outer periphery of the magnet 21 so that the upper side of diaphragm 28 can be blocked. The resonant cover 30 comprises a hole 31 on a side thereof for releasing sound, and an air chamber 32 above the diaphragm 28. A terminal 33 is soldered to the resonant cover 30 through a hole punched in the printed circuit board 27.

A rectangular wave signal is applied to the coil 26 via the terminal 33 of the conventional sounder of the above structure, and thereby produces a magnetic field through a magnetic circuit comprising the magnet 21 and the plate 22. The magnetic force produced by this magnetic field draws the diaphragm 28, which is made of high permeable material such as permalloy, toward the center pole 23 of the plate 22 so that the diaphragm 28 is attracted to the upper surface of the center pole 23. Thus, the diaphragm 28 becomes deflected.

Since a rectangular wave signal is applied to the coil 26, the diaphragm 28 deflects and then restores repeatedly, thereby reproducing a specific sound of frequency band-width. However, there are problems with the conventional sounder. For instance, the coil 26 is not wound directly around the center pole 23. Rather, the coil 26 is wound by a separate process, and then placed around the center pole 23. However, first, both ends of the coil 26 have to be pulled out through the same hole 24 to the back side of the printed circuit board 27. Then, the coil 26 is positioned around the outside of center pole 23, and glued to the center pole. Each end of the coil 26, which has been pulled out to the back side of the plate 22, is then connected with an electrode on the printed circuit board. Then, the terminal 33 is connected with an electrode on the printed circuit board.

As described above, too many components and steps are required to form, position and mount the coil 26 in a specified place, and to be connect the ends of the coil to the backside of the sounder. As a result, the process of assembling the sounder is not very efficient, and can easily result in a sounder that malfunctions.

For example, when connecting the ends of the coil 26 to printed circuit board, the electrodes may be connected with a wrong polarity. Or, the adhesive used in gluing the coil 26 to the center pole may touch the diaphragm 28, and cause the sounder to malfunction.

The present invention intends to solve such problems with a high quality sounder that is assembled with fewer components and steps. The sounder, according to the present invention, is small and slim, and yet is capable being assembled with high efficiency.

DISCLOSURE OF THE INVENTION

In order to solve the above problems, the sounder according to the present invention comprises the following:

(a) a center pole, (b) a coil wound around the center pole, (c) a first plate that is molded to a lower case, and whose base and a part of its periphery are exposed, said first plate having the center pole and a connecting portion connected to an end of the coil, (d) a second plate that also is molded to the lower case, and whose base and a part of its periphery are exposed, said second plate having a connecting portion connected to another end of the coil, (e) a magnet disposed on the periphery of the coil inside the lower case, (f) a diaphragm disposed over an upper side of the magnet and an upper face of the center pole and spaced above the center pole, and (g) an upper case coupled with the lower case covering an upper face of the diaphragm, the upper case having a sound-release-path for releasing radiated sound to the outside.

According to the above structure, the first plate which is molded to the lower case forms a magnetic circuit, and has a connecting portion for the coil. The second plate also has a connecting portion for the coil. The back side of the first and second plates can be used as connecting portions on the outside of the sounder. Thus, the coil can be conductive to the outside simply by being connected to the connecting portions on the inside of the sounder, thereby eliminating the structure and steps needed for both ends of the coil to be pulled through a hole to the outside of a conventional sounder for connections the back side of the sounder.

Both ends of the coil can be coupled with ease to connectors on the upper surfaces of the first and second plates. Thus, the coil can be wound directly around the center pole.

As a result, a number of components, as well as the number of steps is reduced with the present invention, which also make the assembly process more efficient and improves the a quality level of the sounder.

BRIEF DESCRIPTION OF THE DRAWINGS

FIG. 1A is a plan view depicting an embodiment of the sounder according to the present invention.

FIG. 1B is a cross section of FIG. 1A taken along a line A—A.

FIG. 1C is a cross section of FIG. 1A taken along a line B—B.

FIG. 2A is a plan view depicting another embodiment of the sounder.

FIG. 2B is a cross section of FIG. 2A taken along a line A—A.

FIG. 2C is a cross section of FIG. 2A taken along a line B—B.

FIG. 2D is a cross section of FIG. 2A taken along a line C—C.

FIG. 3A is a plan view depicting still another embodiment of the sounder.

FIG. 3B is a cross section of FIG. 3A taken along a line A—A.

FIG. 3C is a cross section of FIG. 3A taken along a line C—C.

FIG. 3D is a side view of a sound-release path that is an essential part of the sounder.

PREFERRED EMBODIMENTS OF THE INVENTION

Embodiment 1

Figure 4A:
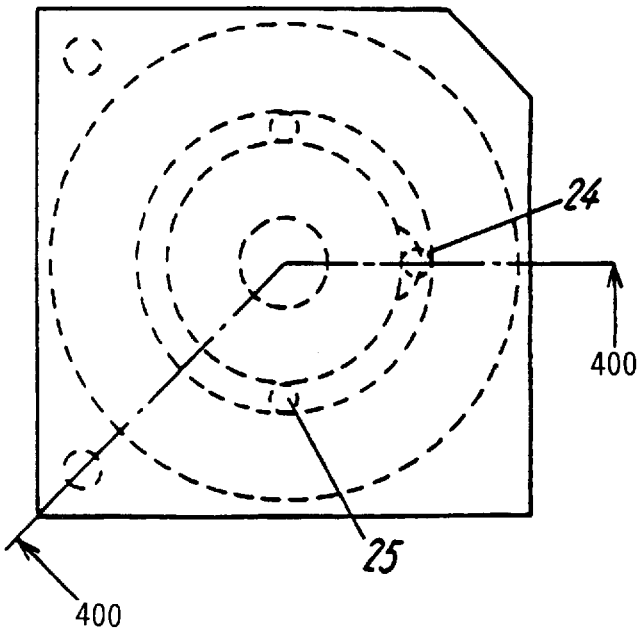
FIG. 4A PRIOR ART
FIG. 4A is a plan view of a conventional sounder.
Figure 4B:
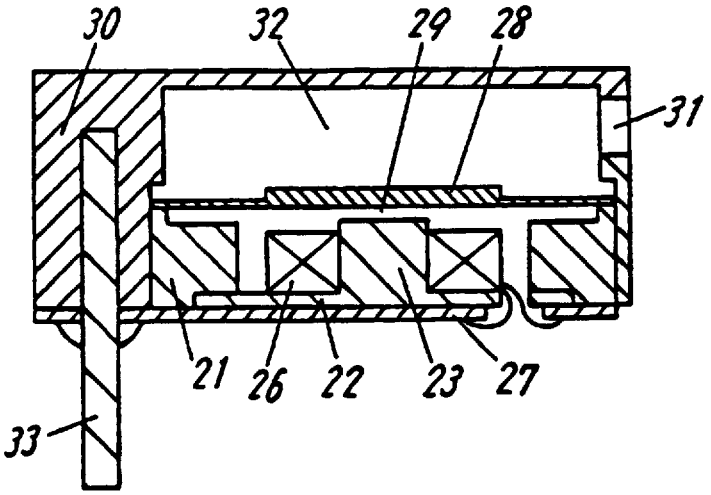
FIG. 4B PRIOR ART
FIG. 4B is a cross section of FIG. 4A taken along a line A—A.

A first embodiment is described with reference to FIG. 1A through FIG. 1C.

A first plate 1 is molded to a lower case 4 so that its base and a part of its periphery is exposed. The first plate 1 has a center pole 2 and a coil connecting portion 3*a*. A second plate 5 is also molded to the lower case 4 so that its base and a part of its periphery is exposed. The second plate 5 has also a coil connecting portion 3.

Outer connector terminals 6 are mounted to the exposed parts of the first and second plates 1, 5.

A coil 7 is wound around the center pole 2, and each end of the coil is coupled with a coil connecting portions 3, 3*a*, respectively, which are mounted to the first and second plates 1, 5, respectively.

A ring-shape magnet 8 is disposed in an outer periphery of the coil 7. The ring-shape magnet 8 is formed by molding a resin magnet.

A diaphragm 9 that is made of high permeable material is situated above the periphery of the resin magnet 8 with a specified gap formed between the back or lower face of the diaphragm and the upper face of the center pole 2.

An upper case 10 is connected to the lower case 4 so that the upper case 10 can block the front face of the diaphragm 9 and form an air chamber 11 above the diaphragm 9, as well as provide a sound release path through the opening 12 for radiated sound.

The first plate 1 may be molded to the lower case 4 by insert molding. The second plate 5 can also be insert-molded to the lower case 4. The ring-shape magnet 8 can be formed by injection molding a resin magnet.

The above structure allows the sounder of the present invention to connect both ends of the coil 7 on the inside of the sounder by connecting an end of the coil upper face to a connecting portion on one of the plates 1*a*, 5. In this manner, the coil 7 can be conductive to the outer connector terminals 6 without having to pull each of the ends of the coil to the outside to make a connection. The step of pulling out both ends of coil 7 to the back side of the plates is eliminated.

Embodiment 2

FIG. 2A through FIG. 2D depict another embodiment of the sounder. The same symbols are used for the same parts described in Embodiment 1.

In the second embodiment, a center pole 13 has an upper face that is wider than the body. In particular, the center pole is formed with an upper lip for preventing a coil 7, which is wound around the center pole 13 from being moved out into a magnetic gap between the center pole 13 and the diaphragm 9.

A first plate 1*a*, which has a coil connecting portion 3*a*, is insert-molded with a lower case 4*a*, so that a base face and a part of its periphery are exposed. The center pole 13 is mounted in the center of the first plate 1*a*.

A center portion of the first plate 1*a*, which holds the center pole 13, is shaped as a cylinder 14 by drawing. Thus, a contacting area with the center pole 13 becomes wider, thereby increasing the efficiency of permeability of the contacting area.

A second plate 5*a*, having the coil connecting portion 3, is also insert-molded into the lower case 4*a*, so that a base face and a part of its periphery are exposed.

The coil 7 is wound around the center pole 13, and one of each end thereof is coupled to a coil connecting portion 3*a*, 3 provided on the first plate 1*a* and second plate 5*a* respectively.

A solder pool 15 (a dint) is provided on each of the coil connecting portions 3, 3*a* as shown in FIG. 2D, to prevent solder from flowing out to a plate when the ends of the coil are soldered to the respective coil connecting portions.

A cylindrical portion 14 of the first plate 1*a* on which the coil 7 is positioned has a raised part with a channel 16 formed therein. This raised portion serves to elevate the coil 7 relative to the inside face of the first plate 1*a*. With such an arrangement, the ends of the coil 7 are closer to the respective coil connecting portions 3, 3*a*.

Each end of the coil 7 is not connected to a coil connecting portions in a taunt manner. Rather, each end of the coil is connected to a connecting portion 3, 3*a* in such a way that there is some slack in the portion of the end of the coil soldered to a coil connector. The slack is provided to prevent the connection from breaking loose to a shock from outside.

A magnet 8*a*, which is made of a molded resin magnet, is disposed around the outer circle of the coil 7. A notch 18 is provided in the magnet 8*a* to provide space for the coil connecting portions 3, 3*a*. This configuration results in a ring-shape magnet 8*a* that is reduced in size.

The outer connector terminals 6*a* are made of a part of the first plate 1*a* and a part of the second plate 5*a*, both of which protrude from the lower case 4*a*.

According to the second embodiment, the number of components, compared to a conventional sounder, is reduced. In this embodiment, the first plate 1*a* and second plate 5*a* can be formed from a piece of metal plate, and can be separated by patching before, or after being molded to the lower case 4*a*.

Embodiment 3

FIG. 3A through FIG. 3D depict still another embodiment of the sounder according to the present invention. The same symbols are denoted for components that are the same as depicted in Embodiment 2, and the details of such components are omitted. Only the differences from Embodiment 2 are explained here.

The upper case 10*a* has a protrusion 19 disposed on the inside of a top plate thereof, and ribs 20 situated on both sides of the opening or sound release path 12. The protrusion 19 prevents the diaphragm 9 from being deformed by a shock from outside. The ribs 20 prevent the diaphragm 9 from projecting into the sound release path 12, thereby allowing the position and the size of the sound release path to be varied in a wide manner. Further, a rib 20*a* is provided in the sound release path 12 so that the diaphragm can be positioned more accurately.

The above embodiments of the sounder according to the present invention provide advantages over the conventional sounder in size and assembly. Specifically, the number of components and steps are reduced, resulting in an improved and more efficient assembly process. As a result, a quality sounder with high performance and small in size is realized.

The sounder according to the present invention provides a plate with the coil connecting portion, thereby allowing the plate to function as a terminal or a connector to the outside.

On the other hand, a conventional plate has only a magnetic circuit thereon. As a result, the number of components and processes relative to the winding and wiring of the coil are reduced, and efficiency and accuracy of the assembly improved. Thus, high performance, as well as high quality, can be achieved simultaneously.

In particular, the present invention has the following features:

(1) When the upper face of the center pole is wider than the body thereof, the center pole prevents the coil wound around the center pole from being moved out into the magnetic gap between the center pole and the diaphragm.

(2) When the center-pole-holding-part of the first plate is shaped to be cylindrical by drawing, this structure widens the contacting area with the center pole, thereby increasing efficiency of permeability of the contacting area.

(3) When a solder pool (a dint) is provided as part of the coil connecting portions situated on the first and second plates respectively, this structure prevents solder from flowing out to a plate to which a magnet is adhered, when both ends of the coil are soldered.

(4) When the portion of a plate on which the coil rests is formed as a raised or protruded section of the plate, the ends of the coil are allowed to be in closer contact the connecting portions on each plate.

(5) When the end of a coil is connected to a connecting portion with some slack in the end, rather in a taunt manner, this manner of making a connection prevents the connection from being broken due to shock from outside.

(6) When a notch is provided in the magnet, the sounder can be reduced in size by positioning the coil connecting portion in the notch.

(7) When a protrusion is provided on the inside of the top plate of the upper case, a deformation of the diaphragm is prevented, and this structure can prevent the diaphragm from being deformed by a shock from outside.

(8) When ribs are provided in the sound release path of the upper case for preventing a projecting of a diaphragm, this structure can prevent the diaphragm from projecting into the sound release path as well as allow the position and size of the sound release path to be made from a wider array of choices.

(9) When a part of the lower case is exposed to the outside as a connector terminal, the plate can function as connector terminal, thereby reducing a number of connector terminals.

(10) When a part of the first plate and the second plate respectively is exposed to outside of the lower case to form each connector terminal, both plates can function as a connector terminal, thereby reducing a number of connector terminals.

(11) When the first and second plates are formed by a piece of metal plate and separated into two parts before or after being insert-molded to the lower case, further reduction of a number of components can be achieved.

Of course, it should be understood that a wide range of changes and modifications can be made to the preferred embodiment described above and that the foregoing description be regarded as illustrative rather than limiting. It is therefore intended that it is the following claims, including all equivalents, which are intended to define the scope of this invention.

What is claimed is:

1. A sounder comprising:

(a) a first plate molded to a lower case, and whose base and a part of its periphery are exposed, said first plate having a center pole and a coil connecting portion, (b) a second plate molded to a lower case, and whose base and a part of its periphery are exposed, said second plate having a coil connecting portion, (c) a coil wound around the center pole, wherein one end of the coil is connected to said coil connecting portion of said first plate and another end of the coil is connected to said connecting portion of said second plate, (d) a magnet disposed on a periphery of the coil, (e) a diaphragm disposed above a periphery of the magnet and an upper face of the center pole, wherein a specified gap is formed between the upper face of the center pole and a bottom face of the diaphragm, and (f) an upper case coupled with the lower case so that the upper case blocks the upper face of the diaphragm and forms a sound release path for releasing radiated sound to outside of the sounder from the upper case.

2. The sounder of claim 1, wherein the upper face of said center pole is wider than a main section said center pole itself, wherein the coil is prevented from moving into the specified gap.

3. The sounder of claim 1, wherein a center-pole-holding part of the first plate for coupling the center pole to the plate is cylindrically-shaped.

4. The sounder of claim 3, wherein the cylindrically-shaped part of the first plate is raised relative to another portion of the first plate.

5. The sounder of claim 1, wherein a dint for pooling solder is provided on each of the coil connecting portions.

6. The sounder of claim 1, wherein the end of the coil that is connected to a coil connecting portion is flexible.

7. The sounder of claim 1, wherein a notch is provided in the magnet as space for the coil connecting portions.

8. The sounder of claim 1, wherein a protrusion is provided on a top plate of the inside of the upper case in order to prevent a deformation of the diaphragm.

9. The sounder of claim 1, wherein a rib is provided in the sound release path of the upper case in order to prevent the diaphragm from projecting into the sound release path.

10. The sounder of claim 1, wherein a part of the plate is exposed to outside of the lower case to form a connector terminal.

11. The sounder of claim 10, wherein a part of the first and the second plates are exposed to outside of the lower case to form a connector terminal.

12. The sounder of claim 10, wherein the first and the second plates are formed by a piece of metal plate, which is separated into two parts before or after the two plates are molded into the lower case.

* * * * *